United States Patent [19]

Bouman et al.

[11] Patent Number: 4,645,967

[45] Date of Patent: Feb. 24, 1987

[54] ELECTRODELESS LOW-PRESSURE GAS DISCHARGE LAMP

[75] Inventors: Anton J. Bouman, Eindhoven, Netherlands; Heiner Köstlin, Aachen-Schleckheim, Fed. Rep. of Germany; Wiggert Kroontje, Eindhoven, Netherlands

[73] Assignee: U.S. Philips Corporation, New York, N.Y.

[21] Appl. No.: 698,300

[22] Filed: Feb. 5, 1985

[30] Foreign Application Priority Data

Feb. 9, 1984 [NL] Netherlands ..... 8400409

[51] Int. Cl.[4] ..... H05B 41/16; H05B 41/24

[52] U.S. Cl. ..... 313/248; 174/50.59; 220/2.1 R; 313/392; 315/344

[58] Field of Search ..... 220/2.1 R; 174/50.59; 315/248, 344; 313/392

[56] References Cited

U.S. PATENT DOCUMENTS

| | | | |
|---|---|---|---|
| 2,159,812 | 5/1939 | Malloy | 220/2.1 R |
| 2,799,421 | 7/1957 | Wildeboer | 220/2.1 R |
| 4,119,889 | 10/1978 | Hollister | 315/248 |
| 4,171,503 | 10/1979 | Kwon | 315/248 |
| 4,568,859 | 2/1986 | Houkes et al. | 313/392 X |

FOREIGN PATENT DOCUMENTS

| | | | |
|---|---|---|---|
| 53-4379 | 1/1978 | Japan | 315/248 |
| 53-4381 | 1/1978 | Japan | 315/248 |
| 53-137577 | 12/1978 | Japan | 315/248 |

*Primary Examiner*—Saxfield Chatmon

[57] ABSTRACT

An electrodeless low-pressure gas discharge lamp includes a glass lamp vessel (1) which is provided with a sealing member (6) connected to the wall of the lamp vessel by means of a suitable sealing material, and which has on its inner wall a conductive layer (7), at least part of which is transparent, that extends beyond the connection to the sealing member (6), the member being slightly recessed into the lamp vessel. The inner conductive layer can thus be connected in a simple manner to an electrical conductor, which during operation of the lamp is connected, for example, to one of the supply wires of the mains.

3 Claims, 2 Drawing Figures

ELECTRODELESS LOW-PRESSURE GAS DISCHARGE LAMP

Figures 1, 2:
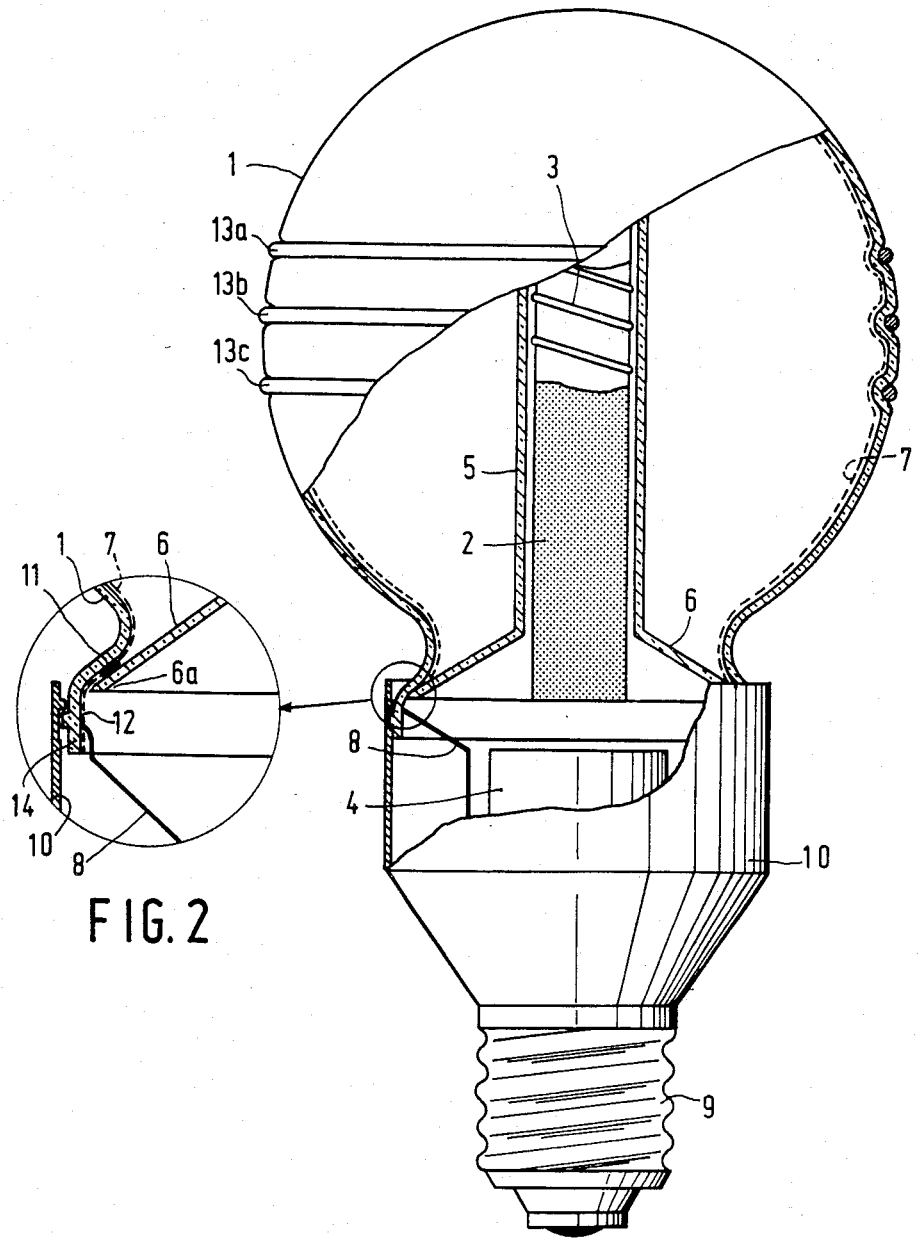

The invention relates to an electrodeless low-pressure gas discharge lamp comprising a glass lamp vessel which is provided with a sealing member connected by means of sealing material to the wall of the lamp vessel in a vacuum-tight manner, which lamp includes a core of magnetic material having arranged therearound a winding connected to an electrical supply unit for producing a high frequency magnetic and electric field within the lamp vessel, the inner wall of the lamp vessel being provided with a transparent electrically conducting layer which is electrically connected by means of a lead-through conductor to a conductor located outside the lamp vessel. Such a lamp is known from Japanese Kokai No. 53-4382 (Application No. 51-78660).

A high-frequency magnetic field is to be understood herein to mean a field which is produced by a supply voltage having a frequency which is higher than about 20 kHz.

In the known lamp, the inner wall of the lamp vessel is provided with a transparent conductive layer in order to avoid the electric field present outside the lamp and originating from the lamp having such a strength that high-frequency interference currents are liable to occur in the supply mains. Due to these interference currents, annoying disturbances occur, for example, in other electrical apparatus connected to the supply mains (such as radio and television apparatus). In the lamp described in the aforementioned Japanese Kokai, the transparent conductive layer is connected by means of a metal rod-shaped lead-through member secured in the wall of the lamp vessel to an electrical conductor located outside the lamp vessel. This conductor is connected to earth in the operating condition of the lamp. The said lead-through construction is complicated. During operation of the lamp, moreover stresses are liable to occur in the glass of the wall of the lamp vessel in the proximity of the lead-through member inter alia due to different coefficients of expansion of the materials used, which could lead to rupturing of the lamp vessel. The electrical connection between the conductive layer and the lead through member is established by means of a metal spring which is secured to the lead-through member and bears against the said layer. At the area of this compression bond, a contact resistance is liable to occur, which is detrimental to a satisfactory operation of the lamp.

The non-prepublished Dutch Patent Application No. 8205025 discloses an electrodeless lamp, in which the transparent conductive layer is connected in the operating condition of the lamp to one of the supply wires of the supply mains. It has been found that with a suitable choice of the sheet resistance ($R_{\square}$) of the layer (for example about 20Ω), the high-frequency electrical interference at the supply mains can be reduced to an acceptable value. The lamp comprises a bulb-shaped lamp vessel which is sealed by means of a sealing member, connected by means of sealing material (such as glass enamel) to the wall of the lamp vessel in a vacuum-tight manner. The lead-through conductor for connecting the transparent conductive layer to an electrical conductor located outside the lamp vessel consists of a metal member which is bent into the shape of a U and is secured at a given area around the edge of the lamp vessel by means of a special conductive paste adhered to the transparent layer. The sealing member is arranged on the said edge and is connected to this edge by means of the sealing material in a vacuum-tight manner. However, the manufacture of this lamp is troublesome and time-consuming due to the use of small separate components. Moreover, there is a risk that in due course in the finished lamp leakage occurs in the lamp vessel at the area of the U-shaped lead-through member. A part of the U-shaped member is moreover located against the outer wall of the lamp vessel, as a result of which special measures are necessary to ensure a sufficient contact safety of the lamp.

The invention has for its object to provide a lamp, in which the lead-through member at the wall of the lamp vessel is such that the aforementioned disadvantages are eliminated as far as possible.

For this purpose according to the invention an electrodeless low-pressure gas discharge lamp of the kind mentioned in the opening paragraph is characterized in that the sealing member is slightly recessed into the lamp vessel, the lead-through conductor being an electrically conducting layer which is located on the inner wall of the lamp vessel and extends as far as a wall portion of the lamp vessel located outside the sealing member.

The lamp according to the invention can be manufactured in a simple manner. The use of specially formed separate components is avoided. The connection with an electrical conductor (for example a wire) located outside the lamp vessel can be readily established. In fact this conductor can be secured to the conducting layer serving as a lead-through, for example, by means of a soldering connection. Since this connection is located on the inner side of the wall of the lamp vessel (but outside the discharge space bounded by the lamp vessel and the sealing member), no additional measures are necessary to ensure a sufficient contact safety of the lamp.

It has been found that the possibility of the occurrence of leakage in the lamp vessel at the area of the lead-through conductor during operation of the lamp is very small as compared with the known lamp. It has been found that the conducting layer which serves as a lead-through member is not attacked by the sealing material (such as glass enamel) between the sealing member and the wall of the lamp vessel.

Favourable results were obtained with a conducting layer serving as a lead-through, which contains, for example, a nickel-iron compound and on which is present a protective layer to prevent attack by the mercury rare gas atmosphere in the lamp vessel. Such a conducting layer is electrically connected through direct contact to the transparent conductive layer (which consists, for example, of fluorine-doped tin oxide) which is present on the inner wall of the lamp vessel. However, in a preferred embodiment of a lamp according to the invention, the lead-through conductor and the transparent conductive layer on the inner wall of the lamp vessel are integral. Additional steps during the manufacture are then avoided. Additional measures to prevent attack by the mercury rare gas atmosphere can moreover be dispensed with.

The gas discharge lamp according to the invention may be, for example, an electrodeless low-pressure mercury vapour discharge lamp, in which a luminescent layer is present on the side of the conductive transparent layer in the lamp vessel facing the discharge. The lamp according to the invention is of such a form that it is suitable to serve as an alternative for an incandescent lamp intended for general illumination purposes.

An embodiment of a lamp in accordance with the invention will be described more fully with reference to the drawing.

In the drawing, FIG. 1 shows diagrammatically, partly in elevation and partly in longitudinal sectional view, an embodiment of an electrodeless low-pressure mercury vapour discharge lamp according to the invention;

FIG. 2 shows, (on an enlarged scale) a sectional view at the area of the connection between the sealing member and the wall of the lamp vessel.

The lamp shown in FIG. 1 is provided with a glass lamp vessel 1, which is filled with a quantity of mercury and a rare gas, such as krypton (about 70 Pa). The lamp is further provided with a rod-shaped core 2 of magnetic material (ferrite), in which during operation of the lamp a high-frequency magnetic field is produced by means of a winding 3 arranged to surround this core and an electrical supply unit 4 connected thereto, which field also extends into the lamp vessel. The winding 3 comprises a number of turns of copper wire. Thus, an electric field is produced in the lamp vessel. The magnetic core 2 and the winding 3 are located in a tubular indentation 5 in a glass sealing member 6. A transparent electrically conducting layer 7 shown in dotted lines, which consists of fluorine-doped tin oxid ($R_{\square}$ about 20Ω), is provided on the inner wall of the lamp vessel 1. A luminescent layer (not shown in the drawing) is provided on this layer and this luminescent layer converts the ultraviolet radiation produced in the lamp vessel into visible light.

The transparent conductive layer 7 is connected to a metal conductor 8, which is located outside the lamp vessel and which is electrically connected (as the case may be via a mains rectifier bridge circuit) to the wall of an Edison cap 9 which is secured to the neck-shaped end of a lamp bowl 10 of synthetic material. The supply unit 4 is also arranged in the space enclosed by the lamp bowl. During operation of the lamp, the transparent conductive layer 7 is then connected to one of the supply wires of the mains.

The conductive layer 7 is transparent, that is to say that the visible light produced by the luminescent layer is transmitted substantially completely by the layer 7.

The sealing member 6, more particularly its peripheral edge 6*a*, is slightly recessed in the neck 14 of the glass vessel 1 (for example approximately 0.5 cm). The conductive layer 7 then extends as far as a wall portion of the lamp vessel located outside the sealing member. This is shown in FIG. 2 on an enlarged scale. A quantity of glass enamel 11 is provided between the wall of the lamp vessel (with the conductive layer 7 on it) and the sealing member 6. The wall of the lamp vessel is formed so that, when the sealing member is secured, a wall portion of this member exerts some pressure force on the oblique wall portion of the lamp vessel. On the lower side of this seal the conductive layer is reinforced along the whole periphery of the neck 14 of the lamp vessel adjacent the peripheral edge 6*a* of the sealing member with a layer 12 of conductive material (for example graphite), which is provided on it and to which the aforementioned conductor 8 is secured. The lamp bowl 10 is secured on the lower side of the outer wall of the lamp vessel, for example by means of a clamping connection.

In the embodiment shown in the drawing, a number of copper rings 13*a*, 13*b* and 13*c* enclosing the discharge are disposed around the lamp vessel 1 at the level of the winding 3, which rings are situated in grooves provided specially for this purpose in the outer wall of the lamp vessel. Due to the presence of these rings, the magnetic field outside the lamp is reduced below an acceptable level.

In a practical embodiment of the lamp described above, the diameter of the glass lamp vessel is about 70 mm at the area of the spherical part and the length is about 90 mm. The lamp vessel contains a small quantity of mercury (about 6 mg) and a quantity of krypton at a pressure of about 70 Pa. The luminescent layer comprises a mixture of two phosphors, i.e. green luminescing terbium-activated cerium magnesium aluminate and red luminescing yttrium oxide activated by trivalent europium.

The magnetic material of the rod-shaped core 2 (length 50 mm, diameter 8 mm) consists of a ferrite having a relative permeability of 150 (Philips 4C6 ferrite). The winding 3 comprises twelve turns of copper wire (thickness about 250 μm). The self-inductance of the coil thus formed amounts to about 8 μH. The supply unit accommodates a high-frequency oscillator having a frequency of about 2.65 MHz (see U.S. Pat. No. 4,415,838).

The transparent conductive layer 7 of fluorine-doped tin oxide is applied by spraying a solution comprising tin chloride and a small quantity of ammonium fluoride in methanol. The layer extends over the whole inner surface of the bulb-shaped lamp vessel as far as the edge of the opening which is provided for receiving the sealing member. This sealing member is slightly sunk into the lamp vessel and is secured by means of glass enamel (consisting, in % by weight, of 74.4% of PbO; 11.4% of ZnO; 8.2% of $B_2O_3$; 1.8% of BaO; 0.8% of $ZrO_2$ and 1.9% of $SiO_2$) to the wall of the lamp vessel in a vacuum-tight manner.

It was measured that, when a power of 13 W was supplied to the lamp, a luminous flux of about 900 lumen was produced.

What is claimed is:

1. An electrodeless low-pressure gas discharge lamp comprising a glass lamp vessel which is provided with a sealing member connected by means of sealing material to the wall of the lamp vessel in a vacuum-tight manner, which lamp includes a core of magnetic material having arranged therearound a winding connected to an electrical supply unit for producing a high frequency magnetic and electric field within the lamp vessel, the inner wall of the lamp vessel being provided with a transparent electrically conducting layer which is electrically connected by means of a lead-through conductor to a conductor located outside the lamp vessel, characterized in that the sealing member is slightly recessed into the lamp vessel, the lead-through conductor being an electrically conducting layer which is located on the inner wall of the lamp vessel and extends as far as a wall portion of the lamp vessel located outside the sealing member.

2. An electrodeless low-pressure gas discharge lamp as claimed in claim 1, characterized in that the lead-through conductor and the transparent conductive layer in the lamp vessel are integral.

3. An electrodeless low-pressure gas discharge lamp as claimed in claim 2, characterized in that the transparent conductive layer consists of fluorine-doped tin oxide.

* * * * *